United States Patent [19]

Enz

[11] 4,183,513

[45] Jan. 15, 1980

[54] CLAMP WEDGE

[75] Inventor: Erhard Enz, Boennigheim-Hofen, Fed. Rep. of Germany

[73] Assignee: Bessy & Sohn G.m.b.H. & Co., Stuttgart, Fed. Rep. of Germany

[21] Appl. No.: 958,596

[22] Filed: Nov. 7, 1978

[30] Foreign Application Priority Data

Jun. 13, 1978 [DE] Fed. Rep. of Germany ..... 2825820

[51] Int. Cl.[2] ..... B25B 1/02

[52] U.S. Cl. ..... 269/203

[58] Field of Search ..... 269/203, 90, 196; 81/154

[56] References Cited

U.S. PATENT DOCUMENTS

| | | | |
|---|---|---|---|
| 678,805 | 7/1901 | Weyand | 269/203 |
| 4,042,264 | 8/1977 | Shumer | 269/203 |

*Primary Examiner*—Robert C. Watson
*Attorney, Agent, or Firm*—Arne I. Fors

[57] ABSTRACT

A slidably adjustable clamp having a locking element in the form of a tapered key for wedging the clamp sliding arm on the clamp rail. The locking element having a bevelled surface on one side is adapted for loose insertion into a rectangular notch formed in the sliding arm opening whereby the locking element can be hammered into wedging engagement between the sliding arm and the rail to lock the arm on the rail. A double-acting wedging effect in both longitudinal and lateral directions is created upon subjecting the locking element to clamping pressures. A second embodiment of the invention comprises a locking element with a planar side which engages a side wall of a trough-shaped recess to laterally engage the sliding arm.

9 Claims, 5 Drawing Figures

CLAMP WEDGE

BACKGROUND OF THE INVENTION

This invention relates to clamps and, in particular, is directed to improvements in slidably adjustable clamps having a fixed ajw and a movable jaw formed on an arm slidably adjustable on a clamp rail.

Screw clamps having a jaw mounted on an arm slidably adjustable on a rail are well known. Pivotal action or tilting of the adjustable arm when a work piece is gripped between the jaws normally locks the adjustable arm on the rail. Although generally satisfactory, this type of slidably adjustable clamp may slip when relatively heavy work pieces are supported under high clamping pressure.

It is a principal object of the present invention to provide an improved clamp having means to positively lock components of the clamp together.

It is another object of the invention to provide a simple and relatively inexpensive improvement to clamping tools which is substantially trouble free and positive in operation.

STATEMENT OF INVENTION

The improvement of the present invention resides in the provision of a locking element in the form of a tapered key which is operatively positioned between an arm slidably mounted on a rail of a clamp tool whereby pivotal action or tilting of the movable arm relative to the rail on which it is slidably mounted under the influence of clamping pressure effectively wedges the components together into a positively locked position. Said locking element in the form of a tapered key has a bevelled surface on one side and preferably a planar surface on the opposite side whereby seating of the locking element longitudinally in a recess having an arcuate cross-section provides a double-acting wedging effect.

The clamping tool of the present invention having a movable jaw that can be slidably adjusted along a rail comprises, in combination, an arm supporting said jaw, said arm having an opening formed therein for loosely receiving said rail, said opening being adapted to receive a locking element having a bevelled surface formed thereon such that said locking element can be wedged within said opening against the rail and the arm, whereby pivotal movement of said arm on said rail positively locks said arm and rail together.

In a preferred embodiment, said locking element comprises an elongated member having a planar side and a bevelled surface formed on the opposite side and the rail has a shallow longitudinal recess with an arcuate cross-section adapted to loosely receive the planar side of the locking element therein, whereby upon tight-fitting abutment of the locking element between the arm and the rail and pivotal movement of said arm on said rail while under the influence of clamping pressure, longitudinal and lateral wedging of the arm and rail together are effected.

BRIEF DESCRIPTION OF THE DRAWINGS

Further characteristics, details and advantages of the invention will become apparent from the following description of the drawings, in which.

Like reference characters refer to like parts throughout the description of the drawings.

DESCRIPTION OF THE PREFERRED EMBODIMENTS

Figure 1:
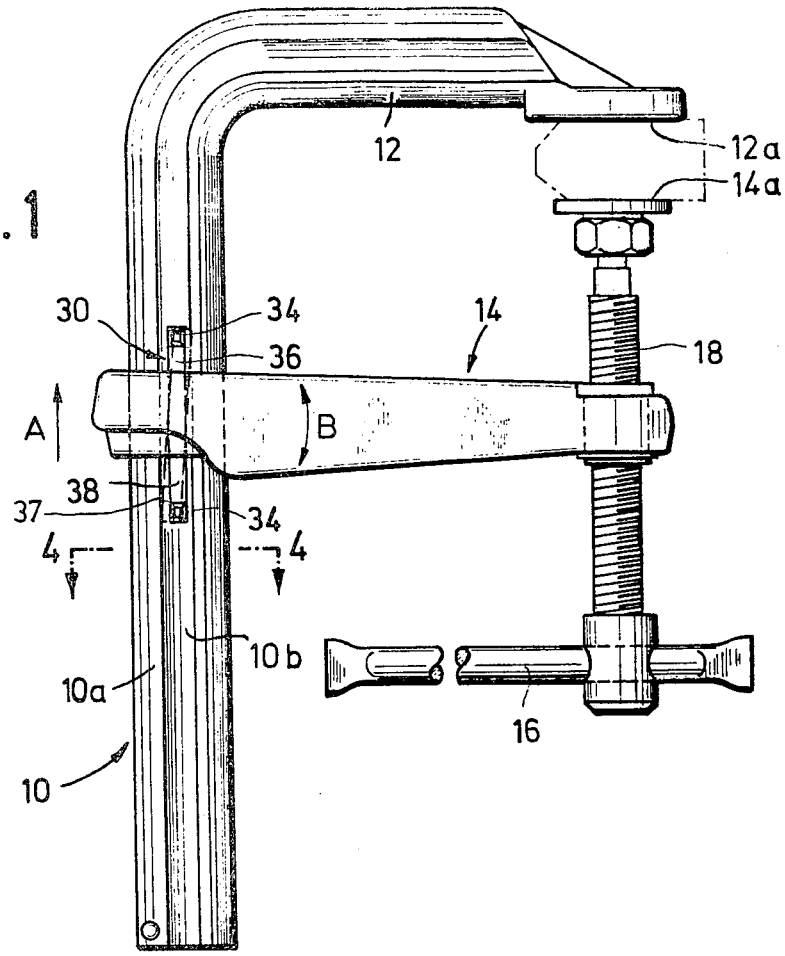
FIG. 1 is an elevation of a screw clamp embodying the present invention.
Figure 4:
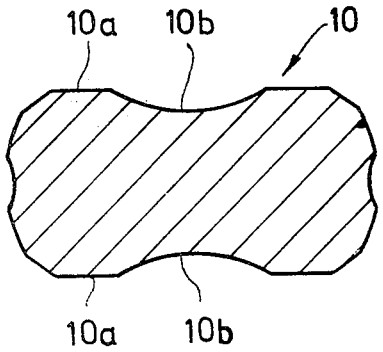
FIG. 4 is a section through the rail of the screw clamp along line 4—4 in FIG. 1.

The screw clamp shown most clearly in FIG. 1 comprises a rail 10 having a portion 12 with flattened stationary jaw **12*a* turned at right angle thereto. As can be seen from the cross-sectional view of FIG. 4, rail 10 has a shallow trough-shaped recess 10*b* extending in the longitudinal direction of the rail formed on each face 10*a***. The preferred radius of each recess is about 20 mm.

An arm 14 holding a screw spindle 18 provided with a turning bar 16 is slidably mounted along rail 10 substantially perpendicular thereto. Screw spindle 18 supports pressure pad **14*a* pivotally mounted as indicated. Pad 14*a* can be extended towards or retracted from jaw 12*a* by turning the screw spindle 18 by means of bar 16**.

Figure 2A:
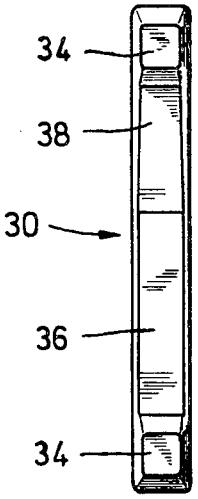
FIGS. 2*a* and 2*b* represent a plan view and a side view respectively of the locking element of the invention.
Figure 2B:
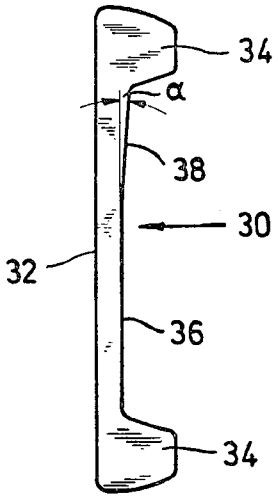
Figure 3:
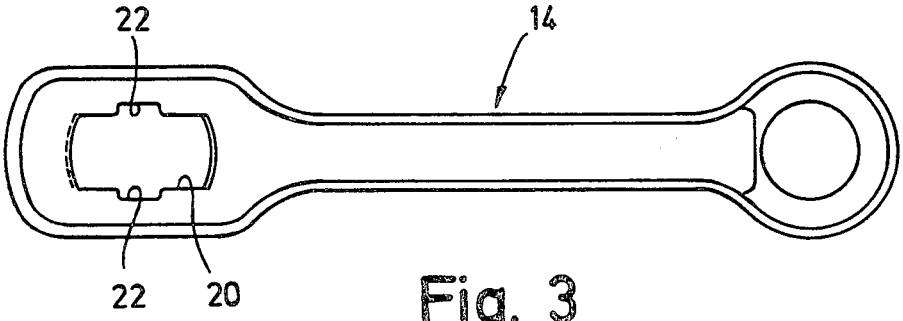
FIG. 3 is a plan view of the sliding arm of the screw clamp shown in FIG. 1.

As can be seen from FIG. 3 the sliding arm 14 has an opening 20 formed at one end to receive rail 10. Opening 20 has two opposed slot enlargements 22, one of which serves to receive locking element 30 shown in FIGS. 2*a* and 2*b*. Locking element 30 is loosely received in a slot 22 of the sliding arm 14 so that it can be moved within the slot and guided therewith as arm 14 is slid along rail 10.

Locking element 30 has a planar rear side 32 that is adapted to seat in trough-shaped recess **10*b* of rail 10 and enlargments 34 at each end depending away from planar side 32. The front side of element 30 has a face 36 parallel to planar side 32 and a bevel face 38 which defines as included angle $\alpha$ of 1° to 6°, preferably 4°, with the rear side 32. A small angle of taper is desired to facilitate freeing of the locking element from its wedging action, to be described. The height of face 36 from rear side 32 corresponds to the depth of slot 22 in opening 20 in the sliding arm 14 so that bevel face 38 can abut against and wedge between the faces of slot 22 and recess 10*b* when the locking element 30 is placed in the sliding arm opening 20 and the sliding arm is assembled with rail 10 such that rear side 22 is seated in rail recess 10*b***.

In operation, sliding arm 14 is positioned an appropriate distance from fixed arm 12 to receive a work piece, such as indicated in FIG. 1, whereupon the sliding arm position can be fixed by driving element 30 in an upward direction as viewed in FIG. 1 by means of a hammer in direction of the arrow "A" so that it is wedged between the wal of the slide arm slot 22 and the one side area **10*b* of the rail 10 by engagement of bevel face 38. Since clamping of the work piece tends to displace sliding arm 14 in a direction opposite to the direction of the arrow "A" and against bevel face 38, the clamping of the work piece leads to strengthened wedging of locking element 30 with sliding arm 14 on rail 10. In addition, the clamping of a work piece causes sliding arm 14 to tend to swing clockwise in the direction of arrow "B" such that the edges of the planar side 32 of the locking element 30 at the ends thereof laterally engage the curved wall of recess 10*b*, shown by ghost lines 37, thereby further strengthening the securement of sliding arm 14 relative to rail 10 by lateral as well as longitudinal wedging of the component parts. Locking element 30 is twisted into a reverse S-shape in plan and is bent into a U-shape in side elevation by the action of arm 14 and the opposite reaction of the side wall of recess 10***b* thereon.

If the screw clamp is inverted relative to the position shown in FIG. 1 such that sliding arm 14 is positioned on top and the fixed arm 12 positioned on the bottom, the additional advantage is obtained of locking element 30 falling into its effective position by its own weight to wedge itself between rail 10 and the wall of the slide arm opening.

The invention can also be used with hydraulically or pneumatically operated clamping tools where the screw spindle 18 of the presented model is replaced by a hydraulic or pneumatic cylinder and piston assembly.

To disengage the locking element 30, the gripping pressure on the jaws is released by retracting movable jaws 14*a* and element 30 is driven by means of a hammer in a direction opposite to the direction of the arrow "A" whereby abutment and wedging of bevel face 38 against arm 14 and lateral abutment and wedging of the side edges of planar side 32 against the curved wall of recess 10*b* are released.

The structure of the invention can be used with locking element 30 inserted in a manner opposite to the position shown in FIG. 1 whereby bevel face 38 does not wedge against the wall of the slot 22 of arm 14. Locking engagement is provided essentially by the lateral engagement of the planar side of the locking element with the curved wall of recess 10*b* due to the twisting action transmitted to locking element 30 by arm 14 through slot 22. In this latter use of the locking element, bevel face 38 can be deleted from the structure.

It will be understood of course that modifications can be made in the embodiment of the invention illustrated and described herein without departing from the scope and purview of the invention as defined by the appended claims.

I claim:

1. A clamp comprising, in combination, an elongated rail having a pair of opposite side faces and a trough-shaped recess with an arcuate cross-section formed longitudinally in at least one of said side faces, a stationary jaw formed at one end of the rail perpendicular thereto, a slider arm having an opening formed therein for receiving the rail whereby said arm is slidably adjustable on the rail, a movable jaw mounted on said slider arm for gripping a workpiece between the jaws, said arm opening having a pair of opposed sides and at least one slot enlargement formed in a side adjacent the trough-shaped recess, and an elongated locking element having a planar base loosely fitted in the arm opening slot enlargement and trough-shaped recess with the said planar base seated in the trough-shaped recess whereby clamping pressure exerted on the jaws pivots the arm and twists the locking member such that the locking member planar base laterally engages the wall of the trough-shaped recess to lock the arm on the rail.

2. A clamp as claimed in claim 1, in which said locking element is tapered and comprises an elongated body having a bevelled face formed on one side defining a wedge angle of about 1° to 6°.

3. A clamp as claimed in claim 1, in which said locking element comprises an elongated body having a pair of opposite planar sides, one of said planar sides having a bevelled surface defining a wedge with the opposite side whereby said locking device can be loosely moved within the arm opening and slot enlargement or forced into tight-fitting abutment between the arm and the rail.

4. A clamp as claimed in claim 3, in which said arm has a pair of slot enlargements comprising a pair of opposed, substantially rectangular slots whereby one of said slots can receive the locking element for guiding the locking element therein.

5. A clamp as claimed in claim 4, in which said bevelled surface defines a wedge angle of about 4° with the opposite side, whereby the thickness of the locking element becomes greater than the arm width of the slot enlargement.

6. A clamp as claimed in claim 1, in which said locking element has an enlargement at each end.

7. A clamp as claimed in claim 6, in which said trough-shaped recess has a concave cross-section with a radius of about 20 mm.

8. A clamp as claimed in claim 6, in which said movable jaw is threadably mounted on said arm for extension towards and retraction from the stationary jaw.

9. A clamp as claimed in claim 6, in which said movable jaw is hydraulically or pneumatically mounted on said arm for extension towards and retraction from said stationary jaw.

* * * * *